United States Patent [19]

Dalmau Güell

[11] Patent Number: 4,934,161

[45] Date of Patent: Jun. 19, 1990

[54] MECHANISM FOR ADJUSTING THE STITCH DENSITY IN CIRCULAR KNITTING MACHINES

[75] Inventor: José M. Dalmau Güell, Barcelona, Spain

[73] Assignee: Jumberca, S.A., Barcelona, Spain

[21] Appl. No.: 212,686

[22] Filed: Jun. 28, 1988

[30] Foreign Application Priority Data

Jul. 20, 1987 [ES] Spain ..... 8702109

[51] Int. Cl.[5] ..... D04B 15/32

[52] U.S. Cl. ..... 66/54

[58] Field of Search ..... 66/27, 54, 77, 48

[56] References Cited

U.S. PATENT DOCUMENTS 3,319,489 5/1967 Philip ..... 66/54 X
3,955,383 5/1976 Hasegawa et al. ..... 66/218 X
4,708,002 11/1987 Lonati ..... 66/218 X
4,712,390 12/1987 Lonati ..... 66/54

FOREIGN PATENT DOCUMENTS 168610 1/1986 European Pat. Off. ..... 66/54

*Primary Examiner*—Wm. Carter Reynolds
*Attorney, Agent, or Firm*—Staas & Halsey

[57] ABSTRACT

A mechanism allows the stitch density to be varied simultaneously with the knitting process by using a single stationary main control with which rotating controls, one for each cam set, successively align. The main control is provided with a motor regulated by a controller, a first sliding member and a proximity detector. Each rotating control includes a second vertical sliding member attached to the stitch cam. According to a program, for each cam set, the motor drives the sliding member and the movement of the latter is applied to the second sliding member through a transmission.

9 Claims, 3 Drawing Sheets

FIG. 4
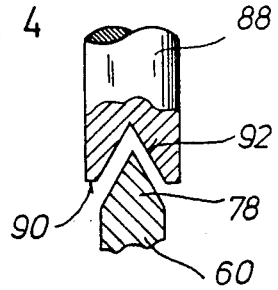
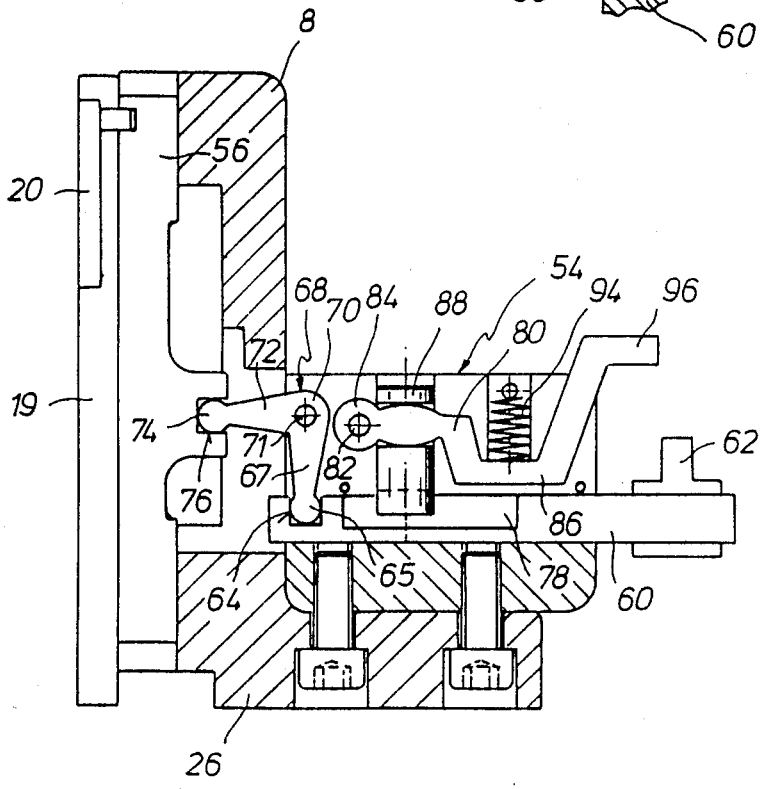
FIG. 3

MECHANISM FOR ADJUSTING THE STITCH DENSITY IN CIRCULAR KNITTING MACHINES

BACKGROUND OF THE INVENTION

1. Field of the Invention

The invention relates to a mechanism for adjusting the stitch density of circular knitting machines of the type having a stationary external portion with a programmable controller and a rotating portion whereon there is mounted a plurality of cam supports, each having a front surface, facing a stationary needle bed and provided with a cam set including a stitch cam, and a rear surface from which there extends a base portion towards said stationary external portion.

2. Description of the Prior Art

With regard to stitch density, knitting machines may generally be subdivided into two major groups, i.e.

those in which it is not possible to vary the density of the stitches knitted by the knitting sets simultaneously with the knitting process and which, therefore may only knit continuous pieces; and those in which it is possible and which, therefore, are adapted to knit garment lengths.

Within the latter group, there are several embodiments of the known art for adjusting the knitted stitch density simultaneously with the knitting process.

In one embodiment, each stitch cam has associated therewith a stepping motor which moves the cam through a mechanical link. There are two drawbacks to this solution: first, the high cost, particularly onerous in the case of machines having many sets and, second, a wide transition zone of stitch density corresponding to the time/space required by the stepping motor to move the cam is created in the fabric.

A further conventional mechanical solution consists of centralizing a change control on the stationary portion of the machine and associating a mechanical control having 6 or 8 preprogrammed positions with the stitch cam of each section.

The control associated with each stitch cam is provided with a star wheel which on engaging a lever of the fixed control causes it to rotate 1/6 or 1/8 turn, which involves the change of position of the stitch cam. Although this solution is cheaper, it is limited in that it is not possible to program more than a limited number of stitch densities and, furthermore, these must be repeated throughout the garment.

SUMMARY OF THE INVENTION

The mechanism of the present invention overcomes the abovementioned drawbacks by way of an embodiment particularly adapted to be applied to machines having stationary needle beds and moving cam sections, particular to circular sweater machines.

In this sense, the mechanism according to the invention, being of the type first mentioned above, is characterised in that it comprises a single main control mounted to said stationary portion and a rotating control for each stitch cam, mounted on said base portion, said rotating controls successively being aligned with said main control which includes: a drive member, having movements controlled by said programmable controller, a first sliding member orientated generally radially and moveable in the same direction by said drive member, and a proximity detector associated with said controller, each of said rotating controls including: a second sliding member orientated generally vertically, movable in the same direction and which on moving moves said stitch cam, and a boss which aligns with said proximity detector prior to the alignment of the main control with the rotating control on which the boss is mounted, there being also a transmission means transmitting the movement of said first sliding member to said second sliding member.

The invention, therefore, provides a combination of partly electronic and partly mechanical, partly moving and partly stationary mechanisms, adapted for programming and independently adjusting the stitch density of the knitted fabric on each knitting set in spaces of less than 0.1 mm.

BRIEF DESCRIPTION OF THE DRAWINGS

Hereinafter, without any intention to restrict the scope of the invention, there is described one preferred embodiment of the invention, with reference to the accompanying drawings; further details, features and advantages of the invention are disclosed in this description. In the drawings:

FIG. 3 is a side elevation view of a rotating control.

FIG. 4 is a schematic partial view of the piston and the third sliding member.

DETAILED DESCRIPTION OF A PREFERRED EMBODIMENT

Figure 1:
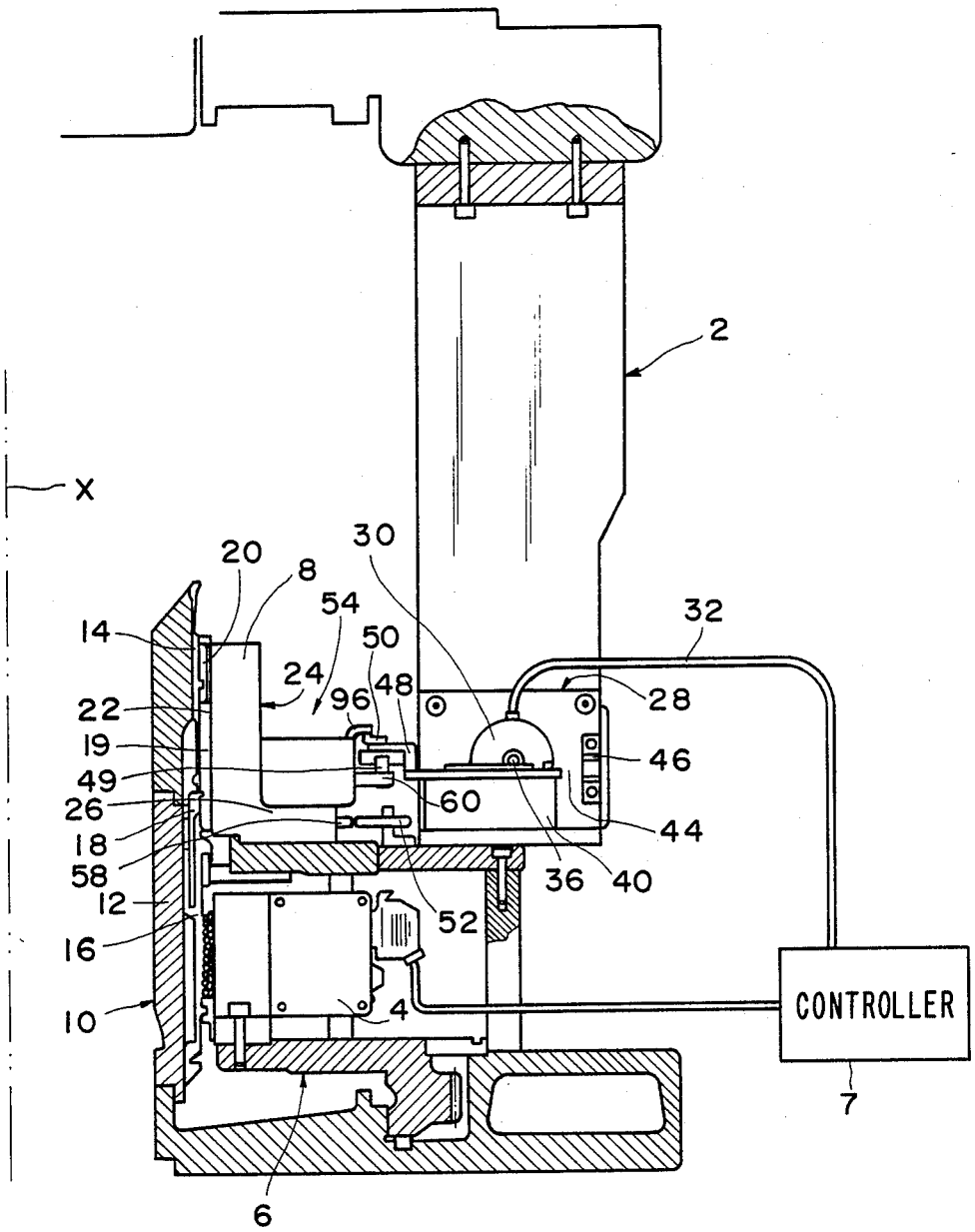
FIG. 1 is a part elevation, part section view showing part of the mechanism of the invention, as well as the location thereof relative to other important parts of the circular knitting machine.
Figure 2:
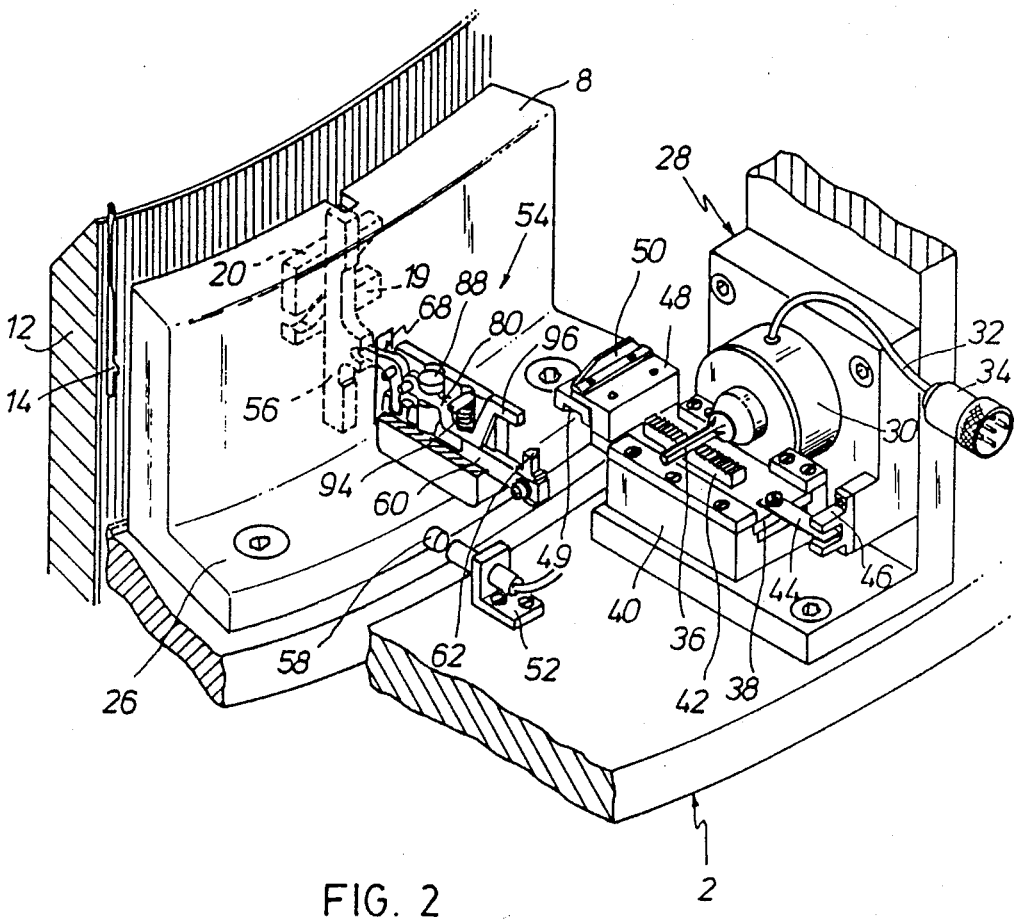
FIG. 2 is a schematic view in perspective of the said mechanism.

The mechanism of the invention has been designed for circular knitting machines. FIG. 1 is a partial view of the stationary external portion 2. In another region of the said portion 2 there is a controller 7 which may be programmed by a keyboard, diskette, magnetic tape, punched paper tape or any other appropriate means. The controller receives information synchronously with the movement of the machine from different members of the machine and transmits commands to other members, such as the selectors 4 and the mechanism itself.

The machine includes a moving or rotating portion 6 rotatable about an axis X and on which there are mounted the needle selectors 4, the cam supports 8 and other members which need not be described for an understanding of the invention. In the central area thereof, the machine is provided with a further stationary portion 10, bearing among other items, the needle bed 12, the needles 14 and the corresponding jacks 16, 18. The needles and the jacks, depending on how they have been selected, are controlled by cams 19, many of which are mounted on the corresponding cam supports 8, outstanding for the purposes of the invention being the stitch cam 20.

Each support 8 has a front surface 22, facing the stationary needle bed 12, where the cams 19, 20 are mounted, and a rear surface 24 from which there extends a base portion 26 which may be integral with the support or be independent thereof. Said base portion 26 extends towards the stationary external portion 2 of the machine.

The mechanism includes a single main control 28 which, as may be seen, is mounted to said stationary external portion 2. The main control includes a drive member, preferably a stepping motor 30, the movement of which is controlled by said not shown controller, to which it is connected by a cable 32 and plug member 34. A pinion 36, to be described presently, forms an extension of the shaft thereof.

There is also provided a first sliding member 38 which is oriented generally radially, i.e. an ideal extension thereof would intersect the ideal axis of rotation of the rotating portion 6 of the machine. Obviously, the orientation of the sliding member is preferably horizontal (i.e. perpendicular to said ideal axis of rotation); nevertheless, the invention also comtemplates the possibility of a certain degree of inclination relative to the said orientation. The sliding member 38 is mounted on a guide member 40 allowing it to move in the direction of its orientation.

The first sliding member 38 is provided on the upper surface thereof with a rack 42 meshing with the pinion 36, whereby the rotation of the motor 30 in one direction or the other causes the first sliding member to feed forward (towards the rotating portion 6) or to retract (away from the rotating portion 6).

The fully retracted position of the first sliding member 38 is predetermined and therein, a detection finger 44 (mounted as an extension of the sliding member at the opposite end to the rotating portion 6) overlaps an optical detector 46 which reads the rearmost position of the sliding member and, therefore, the inoperative position, as expressed hereinafter. This reading of the inoperative position by the optical detector 46 is used by the mechanism as starting point from which the movement increments generated by the stepping motor 30 to reach the programmed positions will depart.

The first sliding member 38 is also provided with a head 48 adapted to be superimposed to the rotating portion 6 and an actuating cam 49 and a release cam 50, the respective functions of which will be described hereinafter, are mounted to the head.

To the main control 28 there is mounted a proximity detector 52, also to be mentioned hereinafter and which is connected to the not shown programmable controller.

Further to the single main control 28 described, the mechanism includes a rotating control 54 for each stitch cam 20. Such controls 54 successively align themselves with the main control, as will be described hereinafter.

Each rotating control 54 includes a second sliding member 56, oriented generally vertically and moveable in the same direction. The vertical sliding member 56 is attached to the corresponding stitch cam so that the latter makes the same movements as the sliding member 56. The vertical sliding member 56 preferably slides on the front surface 22 of the cam support 8.

Each rotating control 54 is provided with a boss 58 which aligns itself during the rotation thereof with the optical control 52 and such alignment occurs prior to the alignment of each moving control 54 with the main control 28.

For the transmission of the movement from the first sliding member 38 to the second or vertical sliding member 56 there are provided transmission means described below.

In the first place there is a third or intermediate sliding member 60. This sliding member is also orientated generally radially and is moveable in the same direction. The same comments as made relative to the direction of orientation of the first sliding member 38 are also pertinent here. The third sliding member 60 is provided with a tooth 62 engaging the operative cam 49 when the first sliding member 38 is not in the retracted position. The engagement of the tooth 62 and cam 49, together with a programmed movement of the first sliding member 38, causes a corresponding movement of the intermediate sliding member 60.

The sliding member 60 is provided with a recess 64 (FIG. 3) in which there is located one end 65 of a first arm 67 of a bell crank or transmission lever 68, capable of pivoting around a shaft 71. The lever 68 is provided with a second arm 72, the end 74 whereof is inserted in turn in a recess 76 of the vertical sliding member 56. The said ends are preferably rounded and an inward (outward) movement of the third sliding member 60 causes an upward (downward) movement of the second sliding member 56 and, therefore of the stitch cam 20.

For correct positioning of the transmission means, particularly of the third sliding member 60, there is provided a locking means. In the first place, the sliding member 60 is provided with a portion 78, the upper surface of which tapers to a point. There is also a locking lever 80 which may rock in a vertical plane around a shaft 82 close to one of the ends 84 thereof. The lever is provided with a U-shaped portion 86 and is connected, in the movement thereof, to a piston 88 whereby the latter is moved generally vertically when the lever 80 rocks. Said piston 88 has a lower surface 90 (FIG. 4) having a V-shaped groove 92, mating in shape with the tapered configuration of the portion 78 of the third sliding member 60, such that when these surfaces engage each other, sufficient friction may be generated to guarantee the immobilization of the third sliding member. It will be seen that the portion 78 is sufficiently long to allow such engagement to take place over a wide range of positions of the sliding member. Finally, there is a spring 94 which engages the U-shaped portion 86 of the locking lever 80 and therefore urges the surface 92 of the groove in tight engagement with the portion 78.

The mechanism also includes release means required to be able to move the third sliding member 60 and, following the kinematic chain, the stitch cam 20. The release means includes an extreme end arm 96 of the locking lever 80. This arm may be actuated by release cam 50 which, overcoming the force of the spring 94, rocks the lever 80 when the first sliding member 38 is not in the rearmost position. This rocking movement separates the piston 88 from the portion 78 of the third slidimg member 60, whereby the latter becomes free to be moved by the engagement of the operative cam 49 and the tooth 62.

The mechanism as described operated as follows: when the boss 58 aligns with the proximity detector 52 (instants before the first and third sliding members align), the latter sends a signal to the not shown programmable controller. The latter reads out of the memory of the fabric to be made the instruction corresponding to the stitch density to be knit by the following set.

If the stitch density corresponding to the following set is unchanged, the controller sends rotation commands to the motor 30 to withdraw the first sliding member 38 to the rearmost position, in which there is no engagement between the cams 49, 50 and the tooth 62 and arm 96. In this position the finger 44 is overlying the optical detector 46 which reads the presence of said finger. This physical determination of the rearmost position of the first sliding member 36 is used by the system, as said above, as starting point with which the movement increments generated by the stepping motor 30 to attain the new programmed positions will depart.

When the stitch density to be knitted in the following set is different from the current one being knitted, the following sequence of operations takes place.

The not shown programmable controller sends rotation commands to the stepping motor 30 to locate the sliding member 38 in the position corresponding to the switch density required.

Consequently, the motor 30 rotates clockwise or anticlockwise and the pinion 36 moves the rack 42, causing the first sliding member 38 to be moved inwardly or outwardly.

The head 48, rotating uninterruptedly, feeds forward and the release cam 50 engages the arm 96 of the locking lever 80. Thus the lever rocks about its shaft 82, overcoming the force of the spring 94 and raising the piston 88, whereby the piston releases the third sliding member 60.

In the position just described, the drive cam 49 engages the tooth 62, causing a component forcing the third sliding member 60 to feed forward or retract, i.e. move inwardly or outwardly. This movement is transmitted to the transmission lever 68 which transmits it in turn to the second vertical sliding member 56.

The positioning terminates while the locking lever 80 is still in the raised position bearing against the release cam 50.

The lever 80 disengages itself from the cam 50 and is urged down by the spring 94. The piston 88 is lowered jointly therewith and the V-shaped notch 92 engages the corresponding tapered edge of the portion 78 of the third sliding member, whereby the set of parts is locked in the position determined by the mutual engagement of the cam 49 and tooth 62.

It should be noted that this locking position occurs in any position within the range of action of the piston 88 against the tapered edge of the portion 78 of sliding member 60, whereby it is possible to lock the unit in any position corresponding to the range of action contemplated for the stitch cam 20.

Through the combination of mechanisms of the invention, the stitch cam 20 may be situated at increments of 0.1 mm in any position within the range of use of the machine. Said position is held by the locking action described which actuates independently of the position programmed by the action of the fixed control and is retained for intervals which are multiples of one machine revolution.

What I claim is:

1. In a mechanism for adjusting the stitch density in circular knitting machines of the type having a stationary external portion with a programmable controller and a rotation portion having an axis of rotation, whereon there is mounted a plurality of cam supports, each having a front surface, facing a stationary needle bed and provided with a cam set including a stitch cam, and a rear surface from which there extends a base portion towards said stationary external portion, the improvement comprising a single main control per knitting section mounted to said stationary portion and a rotating control for each stitch cam, mounted on said base portion, said rotating controls successively being aligned with said main control which comprises: a drive member, having movements controlled by said programmable controller; a first sliding member orientated generally radially relative to the axis of rotation of the rotating portion and movable in the same direction by said drive member; and a proximity detector associated with said controller; while each of said rotating controls comprises: a second sliding member orientated generally vertically, moveable in the same direction and which on moving moves said stitch cam; and a boss which aligns with said proximity detector prior to the alignment of the main control with the rotating control on which the boss is mounted; there being also a transmission means transmitting the movement of said first sliding member to said second sliding member.

2. The improvement of claim 1, wherein said drive member is a stepping motor and is provided with a pinion extending from the shaft thereof and said first sliding member is provided with a rack meshing with said pinion.

3. The improvement of claim 2, wherein the movement of said first sliding member is guided by a guide member and said first sliding member, opposite to said rotating portion of the machine is provided with a position detection finger which in the rearmost position of the sliding member is superimposed over an optical detector.

4. The improvement of claim 1, wherein said second sliding member moves over said front surface of the corresponding cam support.

5. The improvement of claim 3, wherein said transmission means comprise: a drive cam mounted on a head of the first sliding member forming an extension thereof, opposite to said detection finger; a third sliding member, also generally radially oriented relative to the axis of rotation of the stationary portion and moveable in the same direction; a tooth integral with said third sliding member, which engages said drive cam when the first sliding member is not in the retracted position; a transmission lever, capable of pivoting around a shaft and having a first arm the end of which participates in the movement of the third sliding member and a second arm, the end of which participates in the movement of the second sliding member, such that an inward movement of the third sliding member causes an upward movement of the second sliding member and an outward movement of the former causes a downward movement of the latter.

6. The improvement of claim 5, wherein the mechanism is provided with a locking means and a release means for said third sliding member.

7. The improvement of claim 6, wherein the locking means comprises a locking lever operative to rock in a vertical plane about one of the ends thereof and having a U-shaped portion, a piston moveable generally vertically when the locking lever rocks and having a lower surface provided with a V-shaped slot, a V-shaped upper portion of the third sliding member mating with and adapted to be engaged by the groove of said piston, and a spring abutting said U-shaped portion and tending to urge the surface of said groove against said V-shaped upper portion of the third sliding member.

8. The improvement of claim 7, wherein the release means comprises an extreme end arm of said locking lever and a release cam of said head of said first sliding member and said cam engages said arm overcoming the force of said spring and rocking said locking lever when said first sliding member is not in the rearmost position thereof.

9. In a mechanism for adjusting the stitch density in circular knitting machines of the type having a stationary external portion with a programmable controller and a rotation portion having an axis of rotation, whereon there is mounted a plurality of cam supports, each having a front surface, facing a stationary needle bed and provided with a cam set including a stitch cam, and a rear surface from which there extends a base portion towards said stationary external portion, the improvement comprising a single main control per knitting section mounted to said stationary portion and a rotating control for each stitch cam, mounted on said base portion, said rotating controls successively being aligned with said main control which comprises: a drive member, having movements controlled by said programmable controller; a first sliding member orientated generally radially relative to the axis of rotation of the rotating portion and movable in the same direction by said drive member; and a proximity detector associated with said controller; while each of said rotating controls comprises: a second sliding member orientated generally vertically, moveable in the same direction and which on moving moves said stitch cam; and a boss which aligns with said proximity detector prior to the alignment of the main control with the rotating control on which the boss is mounted; there being also a transmission means transmitting the movement of said first sliding member to said second sliding member wherein said drive member is a stepping motor and is provided with a pinon extending from the shaft thereof and said first sliding member is provided with a rack meshing with said pinion.

* * * * *